US008857912B2

(12) United States Patent
Feltrin

(10) Patent No.: US 8,857,912 B2
(45) Date of Patent: Oct. 14, 2014

(54) SEAT ELEMENT

(75) Inventor: Claudio Feltrin, Monastier di Treviso (IT)

(73) Assignee: Arper S.p.A., Treviso (IT)

( * ) Notice: Subject to any disclaimer, the term of this patent is extended or adjusted under 35 U.S.C. 154(b) by 194 days.

(21) Appl. No.: 13/266,170

(22) PCT Filed: Aug. 6, 2010

(86) PCT No.: PCT/IB2010/053571

§ 371 (c)(1),
(2), (4) Date: Oct. 25, 2011

(87) PCT Pub. No.: WO2011/027245

PCT Pub. Date: Mar. 10, 2011

(65) Prior Publication Data

US 2012/0038198 A1 Feb. 16, 2012

(30) Foreign Application Priority Data

Sep. 3, 2009 (IT) ..... PD2009A0250

(51) Int. Cl.
*A47C 4/02* (2006.01)
*A47C 4/03* (2006.01)

(52) U.S. Cl.
CPC .... *A47C 4/02* (2013.01); *A47C 4/03* (2013.01)
USPC ..... 297/440.22

(58) Field of Classification Search
USPC ..... 297/440.1, 440.15, 440.16, 440.22
See application file for complete search history.

(56) References Cited

U.S. PATENT DOCUMENTS

| | | | | |
|---|---|---|---|---|
| 1,232,931 | A * | 7/1917 | Kilburn | 297/440.22 |
| 4,169,627 | A * | 10/1979 | Murphy et al. | 297/440.22 |
| 4,395,071 | A * | 7/1983 | Laird | 297/440.21 |
| 4,488,755 | A * | 12/1984 | Nemschoff | 297/440.21 |
| 5,110,186 | A * | 5/1992 | Clark et al. | 297/440.2 |
| 6,543,842 | B2 * | 4/2003 | Haney | 297/440.22 |
| 6,637,823 | B1 * | 10/2003 | Ursini et al. | 297/440.2 |
| 6,698,840 | B1 * | 3/2004 | Tseng | 297/440.15 |
| 7,832,806 | B2 * | 11/2010 | Yamada | 297/440.15 |
| 7,909,407 | B2 * | 3/2011 | Dudash et al. | 297/440.15 |
| 2004/0245840 | A1 | 12/2004 | Tubergen et al. | |
| 2005/0151409 | A1 * | 7/2005 | Infanti et al. | 297/440.2 |
| 2006/0273642 | A1 | 12/2006 | Lin et al. | |

FOREIGN PATENT DOCUMENTS

WO 2008-140752 A1 11/2008

OTHER PUBLICATIONS

International Search Report and Written Opinion of the ISA, ISA/EP, Rijswijk, NL, mailed Nov. 19, 2010.

* cited by examiner

*Primary Examiner* — Peter Brown
(74) *Attorney, Agent, or Firm* — Harness, Dickey & Pierce, PLC

(57) ABSTRACT

A seat element comprising a frame, a seat associable to said frame, wherein the frame and the seat are made separately from each other and can be engaged and disengaged from each other. Advantageously, the frame comprises at least one lateral plate and the seat comprises at least one tab which, in an assembled configuration, couples at least partially onto said lateral plate in a shaped coupling. Between the at least one tab and the at least one plate a snap coupling element is positioned, which is flexible in relation to the plate and to the tab so as to block the seat to the frame in an assembled configuration of the element.

15 Claims, 4 Drawing Sheets

SEAT ELEMENT

CROSS REFERENCE TO RELATED APPLICATIONS

This application is a 371 U.S. National Stage of International Application No. PCT/IB2010/053571, filed Aug. 6, 2010. This application claims priority to Italian Patent Application No. PD2009A000250, filed Sep. 3, 2009. The disclosures of the above applications are incorporated herein by reference.

FIELD OF THE INVENTION

The present invention relates to a seat element such as a chair, a stool and the like, comprising a frame and a seat made separately and assembled together.

BACKGROUND OF THE INVENTION

It is known of in the art to make seats and frames separately, preferably in different materials, to later assemble them together. The interconnection of the seat and the frame is usually performed using rivets, bolts or screws passing through the seat so as to engage in relative holes made in the frame.

Such structures however present the drawback of requiring for their assembly riveting machines or staff specialised in assembling and connecting parts using the aforesaid means of connection.

For such reason, the seat elements of the prior art are normally assembled during the production phase so that the final product is a chair or stool already assembled and ready for use.

The pre-assembled structure has the disadvantage however of being cumbersome and unwieldy both during storage and relative transport.

Seat element structures in two separate parts having attachment devices and shaped couplings between relative counter-shaped portions of the frame and the seat are also known of in the art.

Such attachment devices and shaped couplings do not however ensure a safe and stable attachment over time: in other words with wear, and on account of the inevitable production tolerance, there is often unacceptable and annoying play between the seat and the frame.

Furthermore, the attachment devices of the known art tend to break during assembly and often ruin the seat by abrasion during assembly and subsequent dismantling phases.

The deterioration of the seat, even if on the under part of the seat and therefore not very visible, is not acceptable in the case in which the seat is, for example, upholstered in valuable material. Furthermore, in the case of an upholstered seat, the friction and damage of the covering may lead to jamming of the mechanism.

SUMMARY OF THE INVENTION

The purpose of the present teaching is to make a seat element which overcomes the drawbacks mentioned with reference to the prior art.

Such drawbacks and limitations are resolved by the disclosed embodiments of seat elements.

BRIEF DESCRIPTION OF THE DRAWINGS

Further characteristics and advantages of the present teaching will be more comprehensible from the description below of its embodiments, made by way of a non-limiting example wherein.

DETAILED DESCRIPTION OF THE INVENTION

Figure 1:
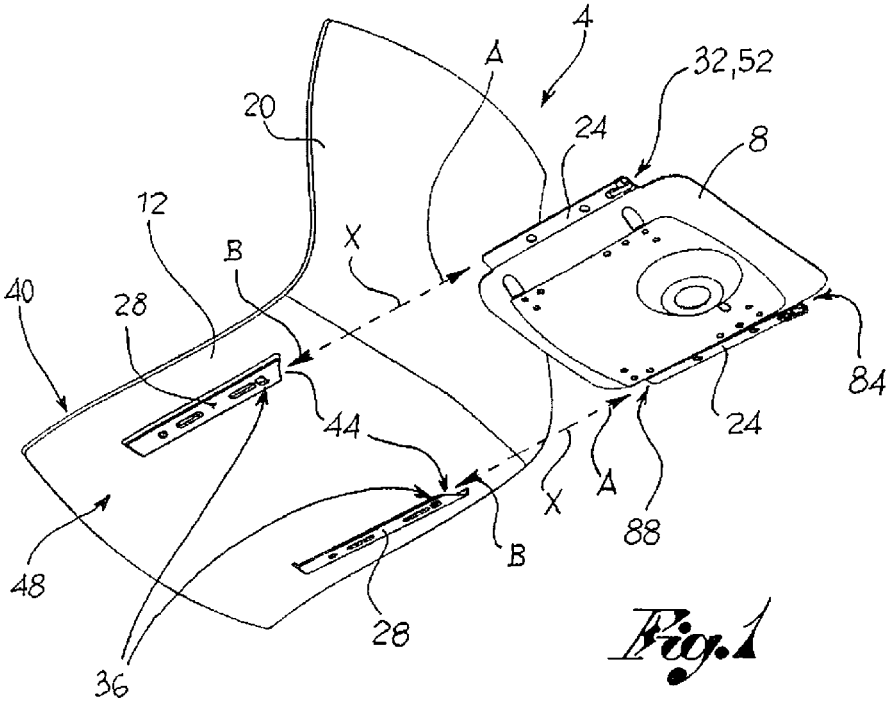
FIG. 1 shows a perspective view in separate parts of a seat element according to one embodiment of the present teaching.
Figure 2:
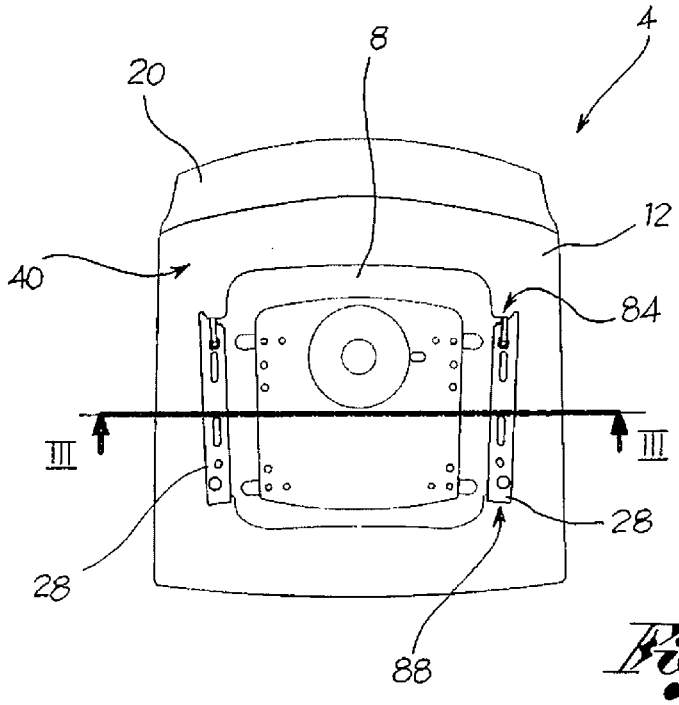
FIG. 2 shows a ground view from below of the seat element in FIG. 1, in an assembled configuration.
Figure 3:
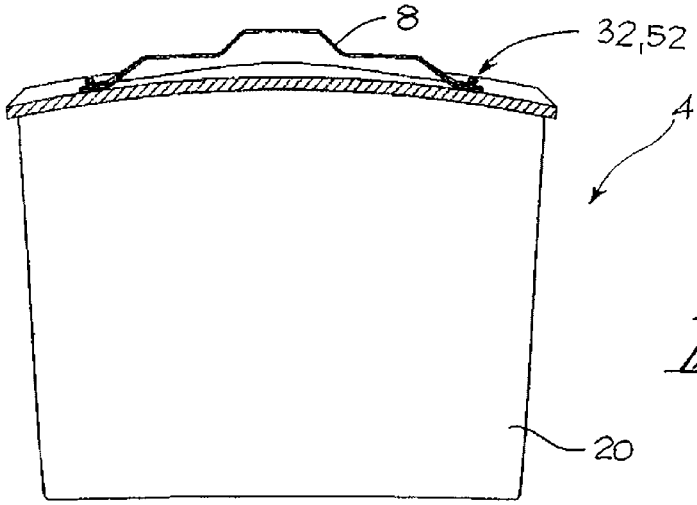
FIG. 3 shows a cross-section view of the seat element in FIG. 1, along the section plane III-III in FIG. 2.

The elements or parts of elements common to the embodiments described below will be indicated using the same reference numeral.

With reference to the aforesaid figures, reference numeral 4 globally denotes a seat element; the seat element may be of any type, such as, for example, a chair, a stool or even an armchair or a sump chair.

The seat element 4 comprises a frame 8 able to support an associable seat 12 and fitted with at least one means of support 16, such as a foot or a leg.

The frame 8 is preferably made in metal and is of the tubular type. The means of support 16 may be of any type, such as for example a plurality of legs, a central column fitted with arms, with or without castors, and so on.

The seat 12 may be of various shapes, materials and sizes and may be with or without a backrest 20.

The frame 8 and the seat 12 are made separately from each other and can be attached and detached from each other, as better described below.

The frame (8) comprises at least one lateral plate (24), and the seat (12) comprises at least one tab (28) which in an assembled configuration, hooks onto said lateral plate (24) at least partially, in a shaped coupling.

Between the at least one tab (28) and the at least one plate (24) a snap coupling element (32) is positioned, flexible in relation to the plate (24) and to the tab (28) so as to block the seat (12) to the frame (8) in an assembled configuration of the seat element (4).

According to one embodiment, the at least one plate 24 has a snap coupling element 32, flexible in relation to the at least one plate 24 and at least one tab 28, and the tab 28 comprises at least one connection seat 36 able to receive the snap coupling element 32 of the plate 24, so as to block the seat 12 to the frame 8 in an assembled configuration of the seat element 4.

The seat 12 comprises a pair of tabs 28 and the frame 8 comprises a pair of lateral plates 24 which, in an assembled configuration, guide the relative sliding between the seat 12 and the frame 8 in an axial direction X-X essentially parallel to a seat plane 40.

The lateral plates 24 are positioned to overhang the frame 8, at the lateral extremities 42 of the frame 8.

According to one embodiment, the tabs 28 of the seat 12 define cavities 44 with a lower wall 48 of the seat 12 and said cavities 44 house the tabs 28 at least partially, in an assembled configuration of the seat element 4.

The lateral plates 24 and the cavities 44 are directed in an axial direction X-X, so as to form a prismatic coupling along said axial direction X-X. Prismatic coupling is taken to mean a coupling of pure translatory movement which prevents a relative rotation between the two coupled elements.

According to one embodiment, the snap coupling element 32 is a spring 52 having an attachment base 56 to the frame 8 and a cantilevered flexible arm 60 provided with one free extremity 64 able to snap engage into the connection seats 36 of the tabs 28 of the seat 12. For example the flexible cantilever arm 60 is connected to the attachment base 56 by a connection portion, for example arc-shaped.

The attachment base 56 is positioned towards the means of support 16, on the side opposite the associable seat 12, so as not to interfere with the seat plane 40.

In other words, the attachment base 56 is attached to the lateral plate 24 of the frame 8 so as not to interfere with the shaped coupling between the lateral plate 24 and the tab 28.

In an idle condition, the flexible cantilever arm 60 is at least partially closed towards the attachment base 56, so that the free extremity 64 of the spring 52 intersects a plane passing through said attachment base 56.

According to one embodiment, the plate 24 comprises, at the height of the snap coupling element 32, a through aperture 68 able to allow the passage of said free extremity 64 of the spring 52.

The free extremity 64 is fitted with a slot portion 72, on the side opposite the attachment base 56, to facilitate the connection of the spring 52 and a front rim 76 of the tabs 28 of the seat 12, during assembly of the seat element 4 in an insertion direction A.

The free extremity 64, on the side opposite the slot portion 72 has a pawl 80 able to prevent relative withdrawal of the seat 12 from the frame 8 in a withdrawal direction B opposite said insertion direction A.

The length of the flexible cantilever arm 60 of the spring 52 is such that, in a connection configuration of the free extremity 64 in the connection seat 36, a connection portion 66 between the flexible cantilever arm 60 and the attachment base 56 reaches its final position against a front rim 76 of the tabs 28, so as to form a limit stop to the coupling of the seat 12 and the frame 8.

The spring 52 is positioned at a rear extremity of the plate 24, on the side opposite the front extremity 88 of the plate 24 suitable for being coupled to a front rim 76 of the tabs 28 of the seat 12; this way the spring 52 prevents reverse assembly of the seat 12 on the side of said rear extremity 84 of the plate 24.

The spring 52 is of the leaf type with a rectangular cross-section.

The spring is made from crude steel so as to yield to the tabs 28 and to the plates 24.

The method of assembling a seat element will now be described.

Figure 4:
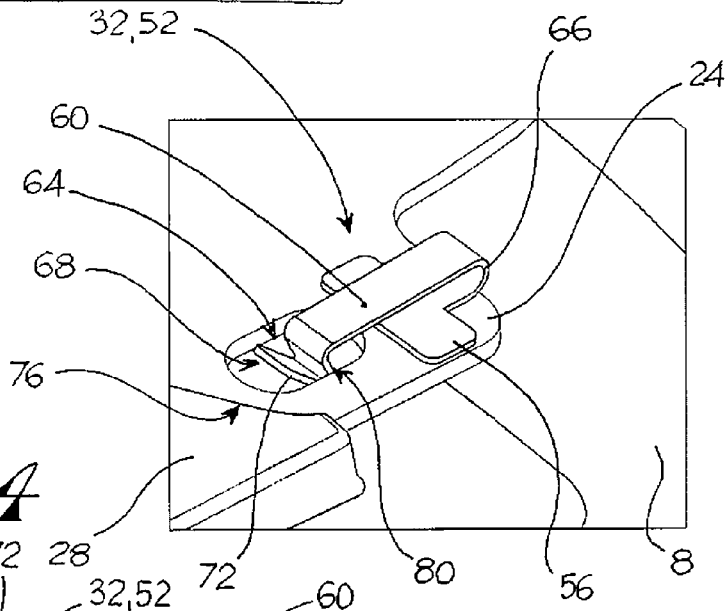
FIGS. 4-6 show enlarged perspective views of the phases of the assembly process of the seat element in FIG. 1.

In particular, the frame 8 is assembled and the seat 12 brought up to it so as to insert the front extremity 88 of the plates 24 into the cavities 44 delimited by the tabs 28 (FIG. 4).

Figure 5:
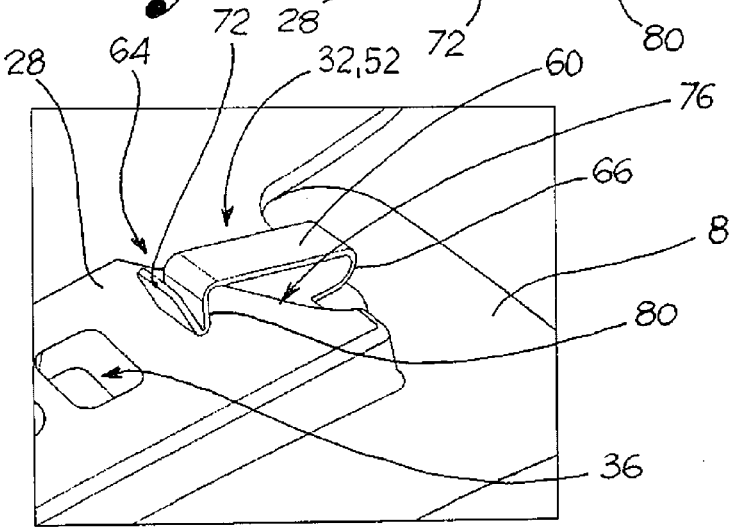
Figure 6:
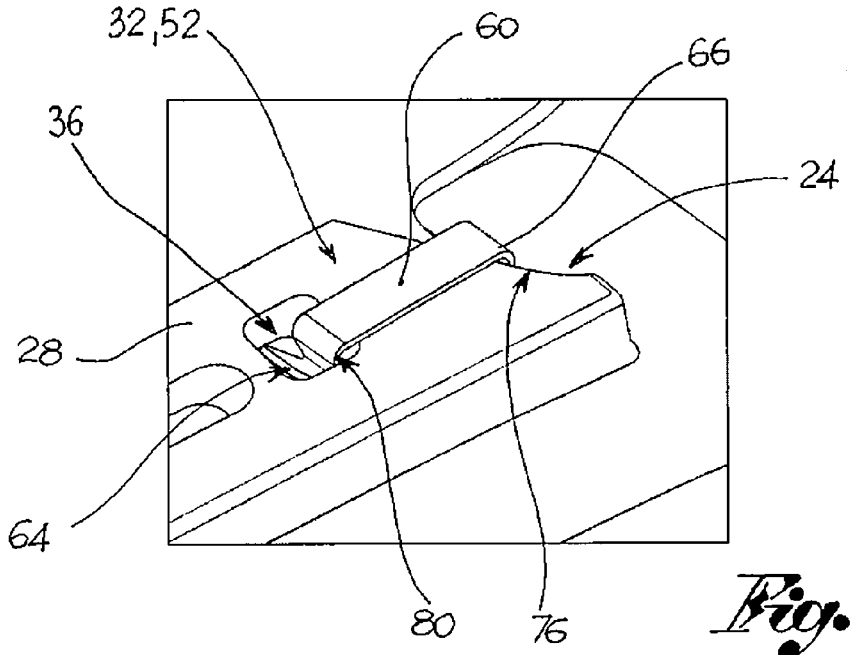
Figure 7:
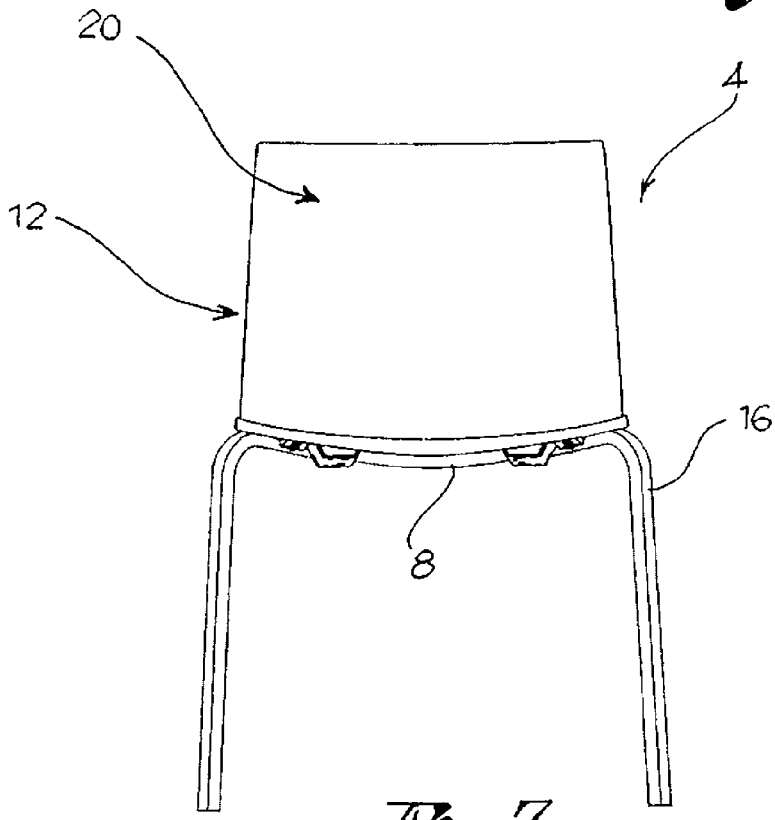
FIGS. 7-8 respectively shows a front view and a ground view from below of a seat element according to a further embodiment of the present teaching, in an assembled configuration.
Figure 8:
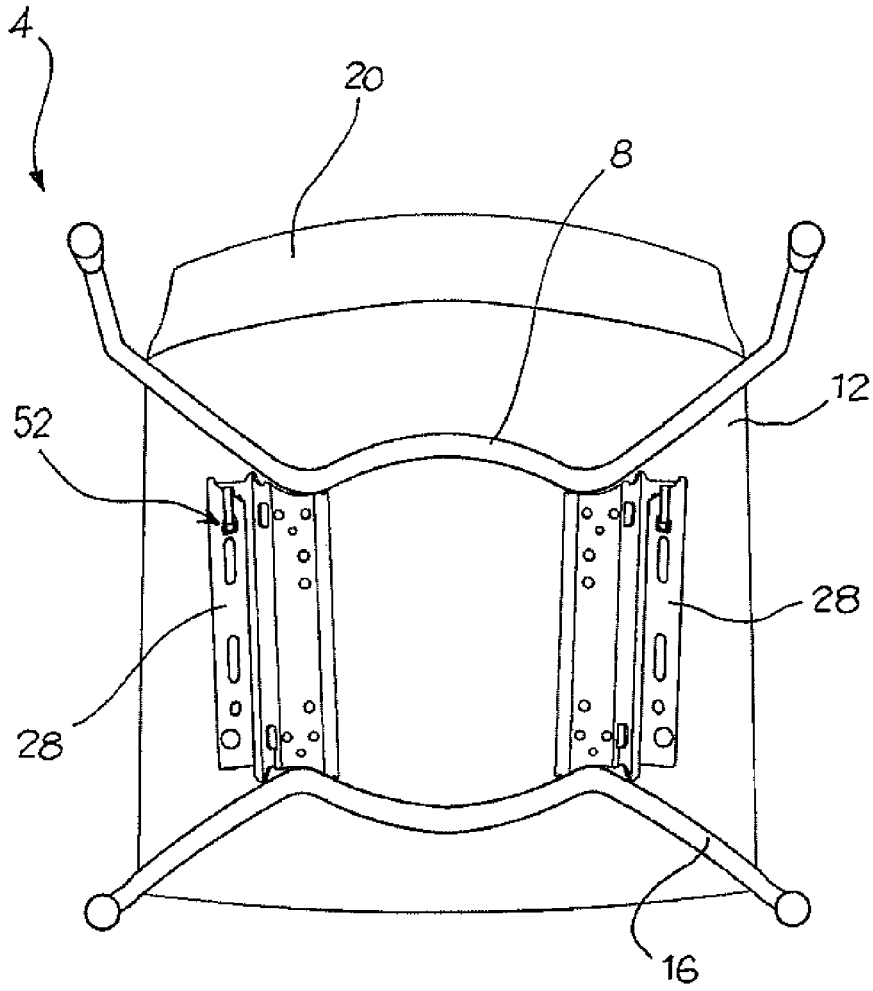

During the coupling of the plates 24 and the tabs 28, near the limit stop of the coupling, the front rim 76 of the tabs 28 intercepts the free extremity 64 of the spring 52. This way the flexible cantilever arm 60 rises flexibly to allow the sliding of the tabs (FIG. 5) until the free extremity encounters the connection seat 36 with which it snap couples (FIG. 6). The limit stop occurs contemporarily with the contact between the front rim 76 of the tabs 28 and the connection portion 66 of the spring 52.

Lastly, to dismantle the seat element 4, it is sufficient to flexibly press the springs 52 so as to disengage the free end 64 from the connection seat 36 and contemporarily slide the seat 12 in relation to the frame so as to pull out the plates 24 from the tabs completely 28.

For example, a screwdriver may be used for the purpose, inserting the tip between the flexible cantilever arm 60 of the spring 52 and the tab 28 of the seat 12.

As may be appreciated from the description, the seat element makes it possible to overcome the drawbacks spoken of in relation to the prior art.

In particular, the seat element is particularly practical and easy to assemble and dismantle.

The coupling and detachment element does not cause any abrasion of the seat or seat covering where present.

The coupling element is sturdy and does not break even if the assembly and dismantling phase is performed repeatedly.

The coupling element is small and practically invisible in conditions of normal use of the seat element.

The cost of producing and assembling the coupling element is extremely limited and does not substantially influence the overall cost of the seat element.

Thanks to the present teachings it is possible to store and transport the seat elements in an easy and practical manner.

Lastly, the number of machines and the labour used to produce the seat elements is reduced.

A person skilled in the art may make numerous modifications and variations to the seat elements described above so as to satisfy contingent and specific requirements while remaining within the sphere of protection of the teaching as defined by the following claims.

The invention claimed is:

1. A seat element, comprising:

a frame able to support an associable seat and fitted with at least one support, such as a foot or a leg; and a seat associated with said frame, the frame and the seat being made separately from each other and being attachable and detachable from each other, wherein the frame comprises at least one lateral plate, wherein the seat comprises a seat bottom lying generally within a seat plane and at least one tab extending from the seat bottom and out of the seat plane, wherein in an assembled configuration, the at least one tab hooks onto said lateral plate at least partially, and wherein between the at least one tab and at least one plate a snap coupling element is positioned, flexible in relation to the plate and to the tab and engageable with the plate and the tab so as to lock the seat to the frame in an assembled configuration of the seat element.

2. The seat element according to claim 1, wherein the at least one plate has a snap coupling element, flexible in relation to the at least one plate and at least one tab, and the tab comprising at least one connection seat is able to receive the snap coupling element of the plate, so as to lock the seat to the frame in an assembled configuration of the seat element.

3. The seat element according to claim 1, wherein the seat comprises a pair of tabs and the frame comprises a pair of lateral plates which, in an assembled configuration, guide relative sliding between the seat and the frame in an axial direction essentially parallel to a seat plane.

4. The seat element according to claim 3, wherein the tabs of the seat define cavities with a lower wall of the seat and said cavities house the tabs at least partially, in an assembled configuration of the seat element.

5. The seat element according to claim 4, wherein the lateral plates and the cavities are directed in an axial direction, so as to form a prismatic coupling along said axial direction.

6. The seat element according to claim 3, wherein the lateral plates are positioned to overhang the frame, at the lateral extremities of the frame.

7. The seat element according to claim 1, wherein the snap coupling element is a spring having an attachment base to the frame and a cantilevered flexible arm provided with one free extremity able to snap engage into connection seats of the tabs of the seat.

8. The seat element according to claim 7, wherein the attachment base is positioned towards the support, on the side opposite the associable seat, so as not to interfere with the seat plane.

9. The seat element according to claim 7, wherein, in an idle condition, the flexible cantilever arm extends towards a plane passing through the attachment base, so that the free extremity of the spring intersects the plane passing through said attachment base.

10. The seat element according to claim 7, wherein the plate comprises, at the height of the snap coupling element, a through aperture able to allow the passage of said free extremity of the spring.

11. The seat element according to claim 7, wherein the free extremity is fitted with an angled portion, on the side opposite the attachment base, to facilitate the connection of the spring and a front rim of the tabs of the seat, during assembly of the seat element in an insertion direction.

12. The seat element according to claim 11, wherein the free extremity opposite the angled portion, has a pawl able to prevent relative withdrawal of the seat from the frame in a withdrawal direction opposite said insertion direction.

13. The seat element according to claim 7, wherein the length of the flexible cantilever arm of the spring is such that, in a connection configuration of the free extremity in the connection seat, a connection portion between the flexible cantilever arm and the attachment base reaches its final position against a front rim of the tabs, so as to form a limit stop to the coupling of the seat and the frame.

14. The seat element according to claim 7, wherein the spring is positioned at a rear extremity of the plate, on the side opposite the front extremity of the plate suitable for being coupled to a front rim of the tabs of the seat, the spring preventing reverse assembly of the seat on the side of said rear extremity of the plate.

15. The seat element according to claim 7 wherein the spring is made from crude steel having a yield strength that is less than that of the tabs and the plates.

* * * * *